US011291303B2

(12) United States Patent
Borras Pons

(10) Patent No.: US 11,291,303 B2
(45) Date of Patent: Apr. 5, 2022

(54) FOLDABLE CHAIR

(71) Applicant: FIGUERAS SEATING SOLUTIONS, S.L., Barcelona (ES)

(72) Inventor: Pablo Borras Pons, Barcelona (ES)

(73) Assignee: FIGUERAS SEATING SOLUTIONS, S.L., Barcelona (ES)

( * ) Notice: Subject to any disclaimer, the term of this patent is extended or adjusted under 35 U.S.C. 154(b) by 0 days.

(21) Appl. No.: 16/283,681

(22) Filed: Feb. 22, 2019

(65) Prior Publication Data

US 2019/0254431 A1 Aug. 22, 2019

(51) Int. Cl.

| | |
|---|---|
| ***A47C 3/04*** | (2006.01) |
| ***A47C 7/48*** | (2006.01) |
| ***A47C 4/04*** | (2006.01) |
| ***A47C 7/00*** | (2006.01) |

(52) U.S. Cl.

CPC ..... *A47C 4/04* (2013.01); *A47C 3/045* (2013.01); *A47C 7/002* (2013.01); *A47C 7/48* (2013.01)

(58) Field of Classification Search

CPC .. A47C 4/04; A47C 7/002; A47C 3/04; A47C 3/045; A47C 7/48

USPC ..... 297/92, 239, 378.1

See application file for complete search history.

(56) References Cited

U.S. PATENT DOCUMENTS 4,850,159 A * 7/1989 Conner ..... A47C 1/126 297/378.1 X
5,658,047 A * 8/1997 Ratza ..... B63B 29/04 297/378.1 X
5,725,279 A * 3/1998 Ward ..... B60N 2/20 297/378.1 X
5,820,220 A * 10/1998 Wu ..... A47C 7/407 297/378.1
5,820,221 A * 10/1998 Greaves ..... A47C 3/16 297/378.14
5,911,471 A * 6/1999 Benedict ..... B60N 2/3011 297/378.1 X
6,030,037 A * 2/2000 Ritch ..... A47C 3/04 297/239
6,045,190 A * 4/2000 Ward ..... B60N 2/20 297/378.1 X (Continued)

FOREIGN PATENT DOCUMENTS

GB 2465172 A 5/2010
JP H01114830 A 5/1989

(Continued)

*Primary Examiner* — Rodney B White
(74) *Attorney, Agent, or Firm* — Maier & Maier, PLLC

(57) ABSTRACT

A foldable chair comprises a seat (1) and a back (2) available according to at least an angular position in which an angular distance between the same is minimum and another angular position in which the angular distance between the same is maximum; and first rotational means configured to define a first axis of rotation and arranged for a first relative angular movement between the seat (1) and the back (2); in addition to second rotational means configured to define a second axis of rotation and arranged for a second relative angular movement between the seat (1) and the back (2). In accordance with this arrangement, the first rotational means and the second rotational means are arranged independently with respect to one another for independent angular movements of the seat (1) and of the back (2) with respect to one another.

10 Claims, 4 Drawing Sheets

(56) References Cited

U.S. PATENT DOCUMENTS 6,089,669 A * 7/2000 Wilcox ..... A47C 1/12 297/378.1
6,106,066 A * 8/2000 Moffa ..... B60N 2/3043 297/378.1 X
6,189,973 B1 * 2/2001 Wu ..... A47C 4/52 297/378.1
6,464,300 B2 * 10/2002 Grove ..... A47C 4/04 297/378.1
6,494,539 B2 * 12/2002 Frank ..... A47C 4/04 297/378.1
6,742,839 B2 * 6/2004 Piretti ..... A47C 3/04 297/239
7,325,873 B2 * 2/2008 Stewart ..... A47C 3/04 297/239
7,472,959 B1 * 1/2009 Ratza ..... A47C 7/407 297/378.1
9,022,480 B2 * 5/2015 Hazzard ..... A47C 4/02 297/378.1
2002/0167211 A1 * 11/2002 Nishi Yama ..... A61H 1/00 297/378.1
2003/0067202 A1 * 4/2003 Alampi ..... A47C 7/407 297/378.1
2006/0103177 A1 * 5/2006 Vergara ..... A47C 9/002 297/378.1 X
2007/0007809 A1 * 1/2007 Han ..... A47C 1/12 297/378.1
2007/0080571 A1 * 4/2007 Clay ..... A47C 7/407 297/378.1
2010/0060065 A1 * 3/2010 Hung ..... A47C 1/03 297/378.1
2010/0295356 A1 * 11/2010 Chen ..... A47C 3/16 297/378.1
2011/0285193 A1 * 11/2011 Loomis ..... A47C 4/04 297/378.12

FOREIGN PATENT DOCUMENTS

JP H048603 A 1/1992
JP H04200406 A 7/1992

* cited by examiner

FOLDABLE CHAIR

CROSS-REFERENCES TO RELATED APPLICATIONS

The present application claims priority under 35 U.S.C. § 119 of Spanish Patent Application No. P201830157 filed on Feb. 22, 2018, the entire contents of which are hereby incorporated by reference.

TECHNICAL FIELD

The present invention is related to the industry dedicated to articulable chairs to be arranged according to a folded position and to an unfolded position.

STATE OF THE ART

Currently, chairs with a seat and a back, arranged in places such as large meeting rooms or halls in which the space occupied by each one of the chairs is relevant, are widely known. As such, in places such as movie theaters, theaters, conference rooms and similar areas where large meetings take place, the chairs arranged are foldable.

The foldable configuration of chairs allows users to arrange them in an unfolded position to make use of them, while at the same time said foldable configuration allows them to be arranged in a folded position by means of which the occupied space is reduced, thereby facilitating the space for walking between rows formed by alignments of the chairs, in addition to facilitating the cleaning of a space around each one of said chairs.

A first solution conventionally used consists of a fixed arrangement of the back and a collapsible or articulable arrangement of the seat for supporting the weight of the corresponding user, or at least the majority of the same. This way when the chair is not in use, it is possible to minimize the required floor space with respect to that which is occupied when it is in use.

This solution, however, has certain limitations, such as those due to the back being arranged in a fixed manner, given that in the folded position, the arrangement of said back is obligatorily according to a slightly inclined plane with respect to a vertical plane for the comfort of the use of the same, thereby resulting in a greater floor space occupied by the corresponding chair.

A second solution conventionally used consists of a fixed arrangement of the seat and a collapsible or articulable arrangement of the back. This way when the chair is not in use, the vertical space occupied by the corresponding chair with respect to that which is required in use is minimized.

This solution however has certain limitations in addition to those that were previously mentioned, given that the fixed arrangement of the seat results in a greater occupation of floor space at all times, both in the folded position and in the unfolded position. This makes it more difficult to pass between the rows of the same, in addition to making it more difficult when cleaning around and under the chairs.

A third solution conventionally used consists of a collapsible arrangement for both the back and the seat. This solution is advantageous with respect to the previously mentioned solution due to the possibility of being able to move both the back and the seat in order to provide a greater degree of comfort in the use of the same, as well as a greater accessibility to the space around said chairs.

However, the aforementioned third solution has an important drawback, which is due to a constraint between the movement of the seat and of the back, both from the folded position to the unfolded position and from the unfolded position to the folded position. In other words, the movement of the seat to the unfolded position involves the movement of the back, specifically according to an opposite direction of rotation, and the movement of the seat to the folded position once again involves the movement of the back.

This third solution therefore has certain limitations both with regard to the resting position thereof and to the position of use thereof, meaning it does not provide flexibility to combine said positions, which, in turn, creates significant limitations during the production of the same, given that the seat and the back must share a single axis of rotation in which mechanisms or means are included for reversing the direction of rotation of one of them with respect to the other, this reverse rotation being done in a way that is synchronized or simultaneous.

In light of the described disadvantages or limitations of current solutions, it is necessary to provide a solution that allows for the movement of the seat and of the back of chairs, in a way that optimizes and allows for greater flexibility in the resting position thereof, the position of rest thereof, as well as the transition between said positions.

OBJECT OF THE INVENTION

With the aim of achieving this objective and solving the previously mentioned technical problems, in addition to providing additional advantages that will be discussed below, the present invention proposes a foldable chair which comprises a seat and a back available according to at least an angular position in which an angular distance between the same is minimum and another angular position in which the angular distance between the same is maximum; and first rotational means configured to define a first axis of rotation and arranged for a first relative angular movement between the seat and the back.

The chair object of the invention additionally comprises second rotational means configured to define a second axis of rotation and arranged for a second relative angular movement between the seat and the back.

In accordance with this arrangement, the first rotational means and the second rotational means are arranged independently with respect to one another for independent angular movements of the seat and of the back with respect to one another. This way there is no longer a constraint between the seat and the back when one of them is moved.

The foldable chair additionally comprises at least a support with a first fastening point and a second fastening point to independently join the first rotational means and the second rotational means to the support. This aspect reinforces the flexibility of the chair object of the invention with regards to the production and assembly thereof, in addition to the independence, or lack of constraint between the angular or collapsing movements of the back and the seat. Likewise, this indicates an optimization in the chair by providing flexibility in the manufacturing and assembly of the same, given that the parts are able to be assembled and obtained in a way that is not constraining among the same.

According to this arrangement, the support preferably has a fastening end, the first fastening point being a shorter distance with respect to the fastening end than the second fastening point. This provides a configuration in the fastening points in a way that contributes to a reduction of the floor space required, in addition to when supporting stresses or weight.

Additionally, and preferably, the first fastening point, the second fastening point and the fastening end are arranged in the support such that a first imaginary straight joining line between the first fastening point and the fastening end and a second imaginary straight joining line between the first fastening point and the second fastening point, form an imaginary angle between 95° and 170°. This arrangement of the first fastening point, the second fastening point and the fastening end results in an optimization in the space required in the support to contribute to an even greater degree to the reduction of the floor space required without compromising the resistance to the stresses to be supported.

The most preferable imaginary angle is between 115° and 155° and even more preferably between 125° and 145°. This way arrangements are provided, each one of which is aimed at providing a greater degree of optimization than the background art in so far as the aforementioned reduction of floor space required and the resistance to the stresses to be supported by the chair.

Preferably, the first imaginary straight line and the second imaginary straight line are contained in the support. Thus, the support is configured to be structurally reinforced with regard to the stresses supported.

The first imaginary straight joining line between the first fastening point and the fastening end are preferably arranged according to a vertical, or substantially vertical, arrangement, the chair being arranged in a location of use. This way, with the first fastening point being the joining point of the first rotational means, while at the same time these rotational means being those which define the axis of rotation of the seat, the element of the chair subjected to greater stresses or weight when the chair is in use, the structural resistance of the support or supports is optimized, and therefore that of the chair as well, in addition to a reduction of the volumetric space occupied on the floor by the chair in a folded position without conditioning the design of the seat or the back.

DETAILED DESCRIPTION OF THE INVENTION

The present invention relates to a foldable chair, which comprises a seat (1) and a back (2). Additionally, the foldable chair comprises first rotational means and second rotational means, which are configured to define a first axis of rotation and a second axis of rotation, respectively. Likewise, the first rotational means and the second rotational means are arranged independently with respect to one another for independent angular movements of the seat (1) and of the back (2).

This way, the back (2) is free to remain immobile with respect to the angular movements of the seat (1) and, likewise, the seat (1) is free to remain immobile with respect to the angular movements of the back (2).

In accordance with a first option, the first rotational means are arranged for angular rotation of the seat (1) and the second rotational means are arranged for angular rotation of the back (2). In accordance with a second option, the first rotational means are arranged for angular rotation of the back (2) and the second rotational means are arranged for angular rotation of the seat (1). In both options, each one of said rotational means is arranged in the foldable chair to provide relative angular movement of the seat (1) with respect to the back (2) in an independent way with respect to one another, and vice versa.

Figure 4:
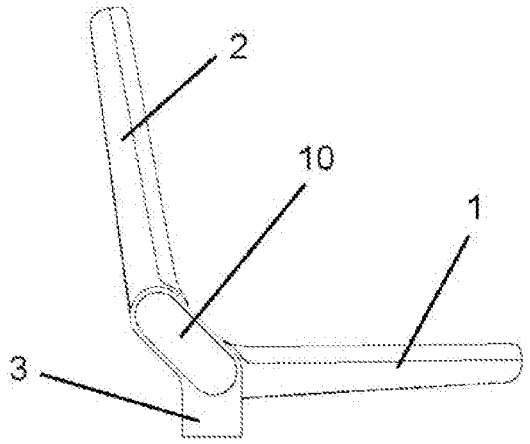
FIG. 4 shows a side view of a chair object of the invention, according to any one of the preferred embodiments, the chair arranged according to an unfolded position.
Figure 5:
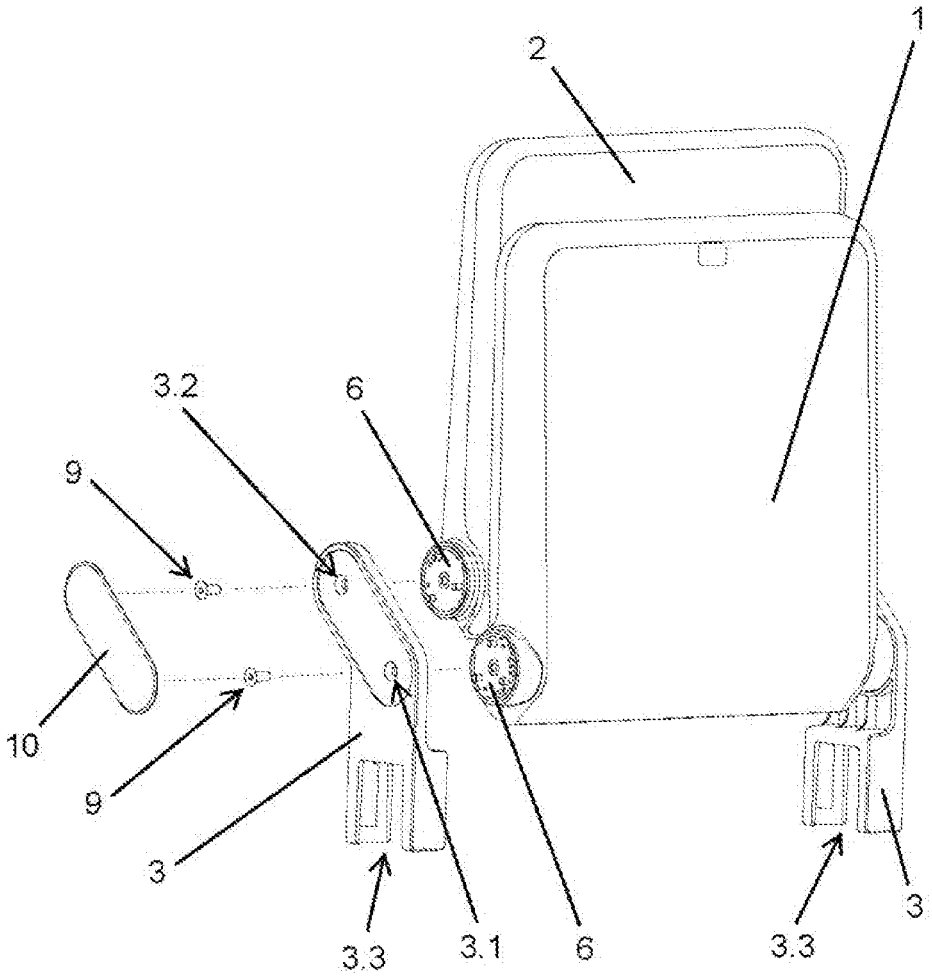
FIG. 5 shows a perspective view of the chair object of the invention, including supports comprised in the chair.

The seat (1) and the back (2) are available according to a first angular position in which an angular distance between the same is minimum and a second angular position in which the angular distance between the same is maximum. The first angular position of the foldable chair can be seen for example in FIGS. 1 and 2, while the second angular position can be seen in FIG. 4. Both the first angular position and the second angular position are established according to the angular rotation limits of the seat (1) and the back (2), preferably two for each one of them (1, 2).

The first angular position corresponds to a resting arrangement of the foldable chair, in other words without angular movement of the seat (1) or the back (2), such that an angle of separation between the two is minimum. This resting arrangement with no angular movement of the seat (1) and the back (2) corresponds to a folded position of the foldable chair. In this folded position, the seat (1) and the back (2) are contained according to parallel, or substantially parallel, planes with respect to one another. The second angular position corresponds to an arrangement of use of the foldable chair, according to which the foldable chair is according to an unfolded position. This arrangement of use is provided with both the seat (1) and the back (2) being angularly moved with respect to the folded position according to a maximum angle of rotation, and therefore according to a maximum angle of separation between the same.

Figure 1:
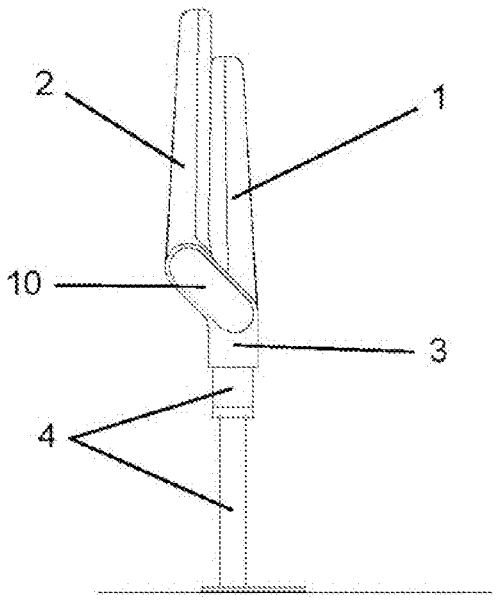
FIG. 1 shows a side view of a chair object of the invention, the chair arranged according to a folded position, according to a preferred embodiment.

According to a first preferred embodiment, the folded position of the chair object of the invention is according to a vertical or substantially vertical arrangement, both of the seat (1) and the back (2), as can be seen in FIG. 1.

According to this first embodiment, the seat (1) and the back (2) are additionally available according to a first intermediate angular position in which the angular distance, or the angle of separation, between the same is greater than in the first angular position and smaller in the second angular position. This first intermediate angular position is determined by the angular movement of the back (2) with respect to the folded position, while the seat (1) is maintained according to the folded position. In other words, the first intermediate angular position corresponds to a first partially unfolded position of the foldable chair by having only the back (2) be angularly rotated with respect to the resting arrangement of the foldable chair.

Likewise, and according to this first preferred embodiment, the seat (1) and the back (2) are available according to a second intermediate angular position in which the angular distance, or the angle of separation, between the same is greater than in the first intermediate angular position and smaller in the second angular position. This second intermediate angular position is determined by the angular movement of the seat (1) with respect to the folded position, while the seat (2) is maintained according to the folded position. In other words, the second intermediate angular position corresponds to a second partially unfolded position of the foldable chair by having only the seat (1) be angularly rotated with respect to the resting arrangement of the foldable chair.

Both the first intermediate angular position and the second intermediate angular position are likewise established according to the rotation limits of the seat (1) and the back (2). This is due to the fact that since the seat (1) is independently angularly rotatable with respect to the back (2), and vice versa, the rotation limits of both (1, 2) allow different combinations to be established, and therefore a greater degree of flexibility in the position of the foldable chair.

Figure 3:
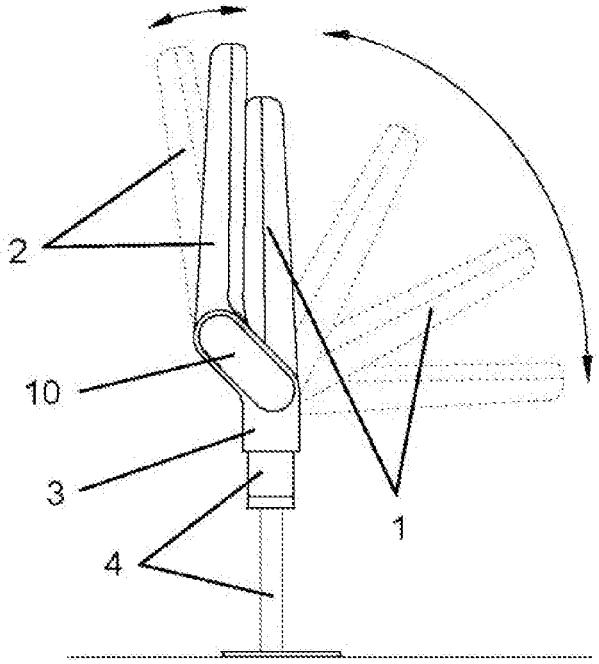
FIG. 3 shows a side view of the chair of FIG. 1, showing the angular movements able to be made by the back and the seat comprised in the chair.

FIG. 3 shows two bidirectional arrows which refer to the angular movements able to be independently carried out by the seat (1) and by the back (2) according to the first preferred embodiment of the foldable chair, the chair being according to the resting arrangement.

In said FIG. 3, for the case of the back (2), the same (2) is shown in a continuous line according to one of the angular positions according to one of the angular limits of rotation thereof and in the dashed line according to another one of the angular positions according to another one of the limits of angular rotation. Likewise, in FIG. 3, in this case for the seat (1), the same (1) is shown in a continuous line according to one of the angular positions according to one of the angular limits of rotation thereof and in the dashed line according to another one of the angular positions according to another one of the limits of angular rotation, in addition to two intermediate angular positions with regard to the same not defined by the limits of the angular rotation thereof.

Figure 2:
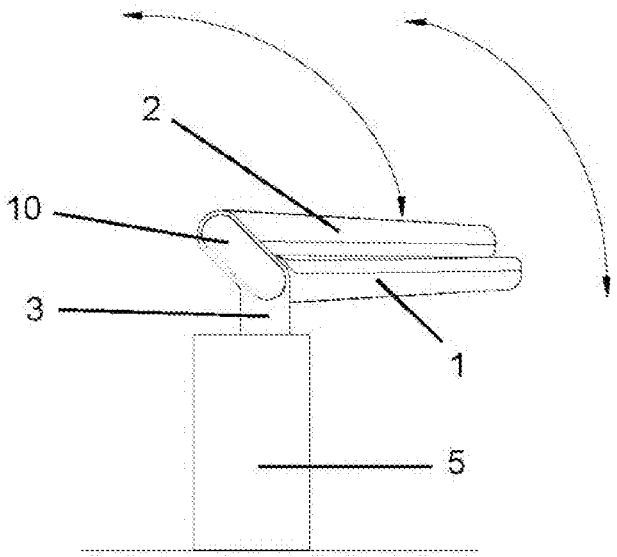
FIG. 2 shows angular movements able to be carried out by a back and a seat comprised in the chair object of the invention, the chair being in accordance with the folded position, according to another preferred embodiment.

According to a second preferred embodiment, the folded position of the chair object of the invention is in accordance with a horizontal or substantially horizontal arrangement, both of the seat (1) and the back (2), as can be seen in FIG. 2.

According to this second embodiment, the seat (1) and the back (2) are additionally available according to a first intermediate angular position in which the angular distance between the same is greater than in the first angular position and smaller in the second angular position. In this case the first intermediate angular position is determined by the angular movement both of the back (2) and the seat (1) with respect to the folded position, or the resting position.

Just like for the first preferred embodiment, in the second preferred embodiment the first intermediate angular position corresponds to a vertical or substantially vertical arrangement of the seat (1) and an angularly displaced arrangement of the back (2) with respect to the seat (1). The first intermediate angular position is established also in accordance with the angular rotation limits of the seat (1) and the back (2).

FIG. 2 shows another two bidirectional arrows which refer to the angular movements able to be independently carried out by the seat (1) and by the back (2) according to the second preferred embodiment of the foldable chair, the foldable chair being in accordance with the resting arrangement.

The foldable chair comprises a support (3) preferably one on each side of the foldable chair for greater support and stability, in other words in correspondence with each side of the seat (1) and of the back (2). The seat (1) and the back (2) are arranged joined together with the possibility of independent rotation between the same and the supports (3), located on the sides thereof. According to this arrangement, each one of the supports (3) has a first fastening point (3.1) and a second fastening point (3.2).

The first fastening points (3.1) are for joining the seat (1) and the support (3) according to the first previously described option, the joint being made by means of the first rotational means. The second fastening points (3.2) are for joining the back (2) and the support (3) according to said first option, the joint being made by means of the second rotational means.

Alternatively, the first fastening points (3.1) equally being for joining the seat (1) and the support (3), according to the second previously described option, this joint is made by means of the second rotational means. Likewise, the second fastening points (3.2) equally being for joining the back (2) and the support (3), according to said second option, this joint being made by means of the first rotational means.

Each one of the supports (3) additionally has a fastening end (3.3) through which an arrangement of the foldable chair is established according to a selected location. This arrangement can be done by means of the placement of pieces, such as tubular elements (4), in correspondence with said fastening ends (3.3), as can be seen for example in FIG. 1. Alternatively, said arrangement can be directly by means of the fastening ends (3.3), for example in a foundation (5), as can be seen for example in FIG. 2.

With the object of maintaining an independence in the angular movements of the seat (1) with respect to the back (2), and vice versa, the first fastening point (3.1) and the second fastening point (3.2) are in the support (3) according to different locations.

Additionally, with the goal of minimizing a total volumetric space definable by the seat (1) and the back (2), both in and of itself as well as by the volumetric space between the same, and preferably according to the folded position of the foldable chair, the first fastening point (3.1) is at a smaller distance with respect to the fastening end (3.3) than the second fastening point (3.2).

The arrangement of the first fastening point (3.1), of the second fastening point (3.2) and of the fastening end (3.3) in the supports (3) is such that starting from the first fastening point (3.1) by means of two imaginary straight lines, it is joined, on one side to the second fastening point (3.2) and, on the other side to the fastening end (3.3), said two straight lines forming an imaginary angle. This angle is preferably between 95° and 170°, and more preferably between 115° and 155°, and even more preferably between 125° and 145°.

Additionally, the support (3) is configured such that each one of said two imaginary straight joining lines, one for the first fastening point (3.1) with the second fastening point (3.2) and another for the first fastening point (3.1) with the fastening end (3.3), pass through contained by the support (3) itself.

In turn, and preferably, with the foldable chair arranged according to the corresponding location by means of the fastening ends (3.3), said fastening ends (3.3) being the parts located vertically at a lower point, the fastening end (3.3) is able to be vertically, or substantially vertically, aligned with the first fastening point (3.1). This way, the weight to be supported by means of the first rotational means, and therefore also by the corresponding first fastening points (3.1), are entirely supported in the support (3) between the fastening end (3.3) and the first fastening point (3.1), in other words with all of the intermediate points between the fastening end (3.3) and the first fastening point (3.1) being free from a cantilever arrangement.

Likewise, using in this occasion the fastening end (3.3) as a reference such that the same (3.3) is joined to the first fastening point (3.1) by means of a first imaginary strait joint, and independently, to the second fastening point (3.2) by means of a second imaginary straight joint, said second imaginary straight joint is angularly displaced with respect to the first imaginary straight joint. This angular movement is in an opposite direction to that of the location of the seat (1), in other words, towards an opposite side in correspondence with the seat (1) or towards a rear part of the back (2) and therefore of the foldable chair.

This way, the described total volumetric space definable by the seat (1) and the back (2) is optimized, while at the same time providing flexibility in the design and assembly of the chair and, more specifically, the seat (1).

In the case of having the first fastening point (3.1), the second fastening point (3.2) and the fastening end (3.3) aligned, the design of the seat (1) would be compromised, for example, to be able to have the foldable chair arranged in accordance with the folded position with the back (2) and the seat (1) in accordance with the vertical position, or simply this position of the foldable chair would be impossible.

On the other hand, in the case of the first fastening point (3.1) and the second fastening point (3.2) being aligned, while the first fastening point (3.1) is aligned with the fastening end (3.3), with both alignments forming a straight, or substantially straight, angle; in other words, with the first fastening point (3.1) and the second fastening point (3.2) being horizontally aligned, or practically horizontally aligned, and the first fastening point (3.1) and the fastening end (3.3) being vertically aligned, or practically vertically aligned, would involve increasing the described total volumetric space definable by the seat (1) and the back (2), both due to a measurement taken passing through the seat (1) and the back (2) and to the increase in the measurement of the back (2) for a maximum determined height of the same.

Figure 6:
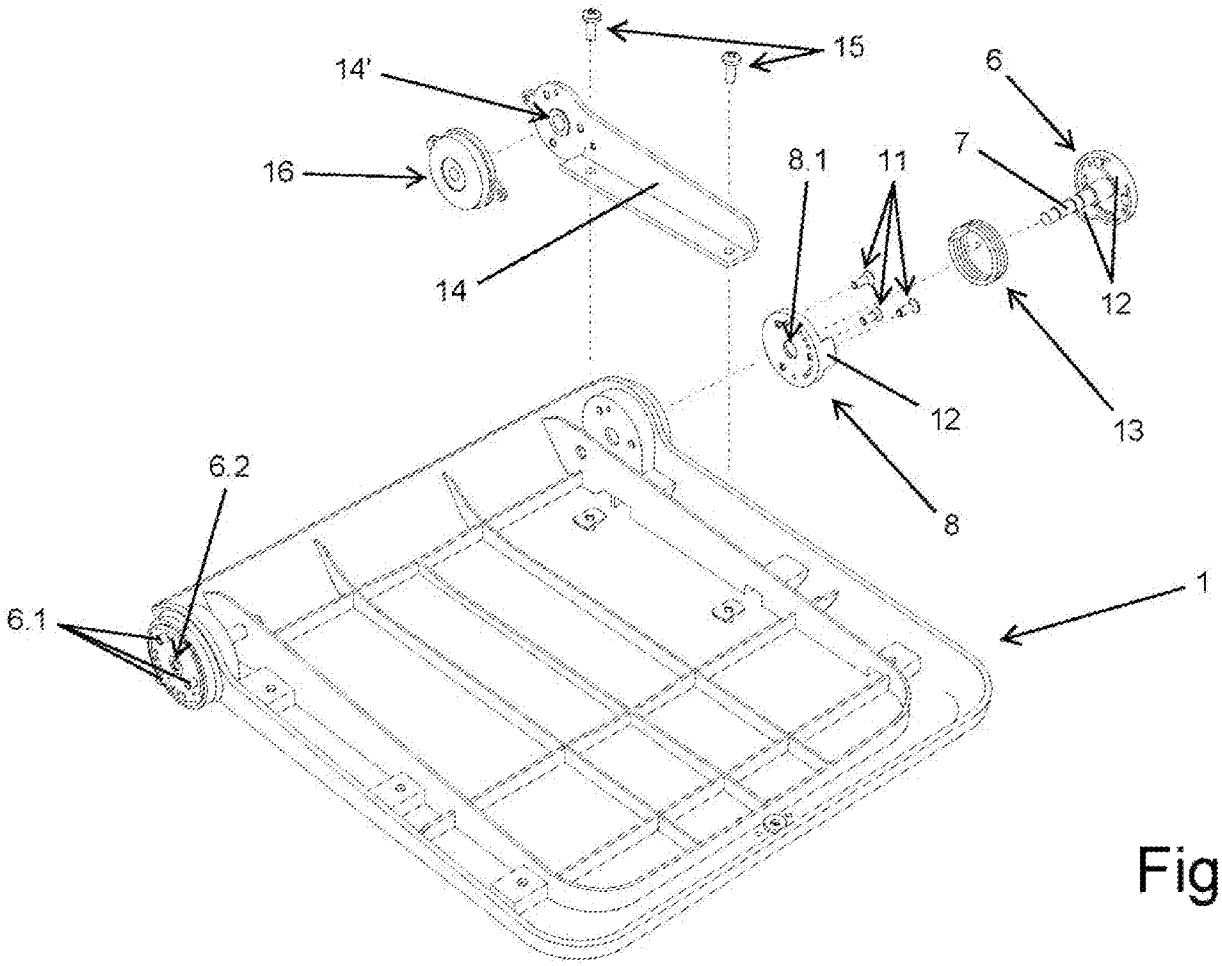
FIG. 6 shows an exploded view of the seat comprised in the chair object of the invention.

Preferably, the first rotational means or the second rotational means, and more preferably both the first rotational means and the second rotational means, comprise an assembly of components in correspondence with each one of the sides of the foldable chair, which will be described below. Furthermore, said description of these components refers only to the seat (1) with the support of FIG. 6, although said same components can be used in the additional way described, or alternatively in the back (2).

Between the components comprised in the first rotational means and/or the second rotational means is a male plate (6), a rod (7) and a female plate (8). Mainly, these components, together with the arrangements thereof, physically determine the first and/or second axis of rotation.

The rod (7) is arranged projecting from a central part of an inner face of the male plate (6). In an outer face of the male plate (6), opposite the location of the rod (7), said male plate (6) has protrusions (6.1) to be arranged embedded or fitted in the support (3). By means of the arrangement by fitting or embedding of the protrusions (6.1) in the support (3), a relative rotation is prevented between the male plate (6) and the support (3), and therefore between the rod (7) and the support (3), even before angular movements between the folded position and the unfolded position of the foldable chair.

Additionally, the male plate (6) includes a fastening hole (6.2). This fastening hole (6.2) extends from the outer face and by an inner part of the rod (7). According to this arrangement, the foldable chair comprises a fastening element (9), preferably a threadless screw or bolt, for each one of the male plates (6). Thus, the male plate (6) is fastened to the support (3) by means of the fastening element (9) by screwing or press-fit into the fastening hole (6.2) prior to the insertion of the fastening element (9) through the support (3). The insertion of the fastening element (9) through the support (3) is done in correspondence with the first fastening point (3.1), since it is related to the seat (2), as was previously indicated.

According to this arrangement, the foldable chair preferably comprises a decorative element (10) available fitted in the support (3) such that it externally covers the first fastening point (3.1) and the second fastening point (3.2), making access to the same and thereby to the fastening elements (9) impossible.

The foldable chair comprises one or several joining elements (11) for each one of the female plates (8), preferably threadless screws or bolts. The joining elements (11) are arranged threaded or fitted in the seat (1) before or after the insertion through the female plate (8) for the fixed joining thereof. By means of this fixed joint, a relative rotation between the female plate (8) and the seat (1) is prevented.

The female plate (8) includes a through hole (8.1) through which the rod (7) is arranged inserted. The rod (7), being inserted through the through hole (8.1), has relative rotational ability with respect to the female plate (8), and therefore with respect to the seat (1), by said female plate (8) being arranged joined in a fixed way to the seat (1).

With the goal of establishing angular rotation limits, in this case of the seat (1), although additionally or alternatively for the back (2), both the male plate (6) and the female plate (8) include stop elements (12). The angular rotation limits are established by means of contacts of the stop elements (12) of the male plate (6) with the stop elements (12) of the female plate (8) by the relative rotation between both plates (6, 8). The stop elements (12) are preferably tabs projecting form the inner face of the male plate (6) and from an outer face of the female plate (8), the tabs being angularly distributed.

With the aim of exerting an inclination or stress on the seat (1) for the arrangement thereof in accordance with the resting arrangement or folded position, the first rotational means and/or the second rotational means comprise at least a recovery element (13) in correspondence with each one of the sides, in this case, of the seat (1). The recovery elements (13) are arranged joined both to the male plate (6) and to the female plate (8). Preferably, the recovery elements (13) are a torsion spring.

The first rotational means and/or the second rotational means preferably comprise a plate (14) with a through opening (14'), in addition to coupling elements (15) to fasten the plate (14), in this described case in the seat (1).

The plate (14) is arranged fixed between the coupling elements (15), preferably screws, such that the rod (7) is arranged inserted through the through opening (14'), in addition to through the through hole (8.1) of the female plate (8), of the recovery element (13) and of a side wall of the seat (1).

With the aim of exerting a regulation or a reduction in the angular velocity in the angular movements exerted by the recovery elements (13) or by a user of the foldable chair, preferably in the angular movements of the seat (1) for the arrangement thereof according to the folded position, the first rotational means and/or the second rotational means comprise a damping element (16). Said damping element (16) is arranged fixed in the plate (14) and configured to receive the rod (7), such that it regulates or reduces the relative angular velocity between the rod (7) and the plate (14), and this way between the support (3) and the seat (1).

According to the aforementioned points, in the naming and the description of the components comprised in the first rotational means and/or the second rotational means, the seat (1) can be substituted by the back (2), or they can be located and arranged both in the seat (1) and in the back (2).

The invention claimed is:

1. An articulable chair, comprising:

a seat and a back being placed to have at least a first angular position in which an angular distance between the seat and the back is minimum and a second angular position in which the angular distance between the seat and the back is maximum;

first rotational means configured to define a first axis of rotation and arranged for a first relative angular movement between the seat and the back, the first rotational means being disposed at one end of a side of the seat; and second rotational means configured to define a second axis of rotation and arranged for a second relative angular movement between the seat and the back, the second rotational means being disposed at one end of a side of the back, wherein the first rotational means and the second rotational means are arranged independently with respect to each other for independent angular movements of the seat and the back with respect to each other, wherein each of the seat and the back is placed in a substantially vertical position and in a substantially horizontal position as being independently moved using the first rotational means and the second rotational means, wherein the articulable chair further comprises a support that includes a first fastening point and a second fastening point to independently connect the first rotational means and the second rotational means to the support, respectively, the support further including a fastening end that is connected to a foundation to fix the articulable chair to the foundation attached to a floor, wherein each of the first rotational means and the second rotational means comprises:

a male plate;

a rod projecting from a central part of an inner face of the male plate;

a female plate including a through hole through which the rod is inserted, wherein the male plate has protrusions to be embedded in the support in an outer face of the male plate, so that a relative rotation between the male plate and the support is prevented, and wherein the rod has relative rotational ability with respect to the female plate and the seat by the female plate being attached in a fixed way to the seat.

2. The articulable chair, according to claim 1, wherein the first fastening point is in a shorter distance with respect to the fastening end than the second fastening point.

3. The articulable chair according to claim 2, wherein the first fastening point, the second fastening point and the fastening end are arranged in the support such that a first imaginary straight joining line between the first fastening point and the fastening end and a second imaginary straight joining line between the first fastening point and the second fastening point form an imaginary angle between 95° and 170°.

4. The articulable chair according to claim 3, wherein the first imaginary straight line and the second imaginary straight line are contained in the support.

5. The articulable chair according to claim 1, wherein the male plate and the female plate include stop elements, and angular rotation limits of the articulable chair are established by means of contacts of the stop elements of the male plate with the stop elements of the female plate by the relative rotation between the male and female plates.

6. The articulable chair according to claim 5, wherein the stop elements are tabs projecting from the inner face of the male plate and from an outer face of the female plate, the tabs being angularly distributed.

7. The articulable chair according to claim 1, wherein each of the first rotational means and the second rotational means further comprises a recovery element that is connected to and disposed between the male plate and the female plate.

8. The articulable chair according to claim 7, wherein the recovery element is a torsion spring.

9. The articulable chair according to claim 1, wherein each of the first rotational means and the second rotational means further comprises:

an inner plate having a through opening; and coupling elements to fasten the plate in the seat or the back, wherein the inner plate is fixed by the coupling elements to the seat or back, and the rod is inserted through the through opening.

10. The articulable chair according to claim 1, wherein each of the first rotational means and the second rotational means further comprises a damping element that is fixed in the inner plate and receives the rod, the damping element regulating or reducing a relative angular velocity between the rod and the inner plate and between the support and the seat or the back.

* * * * *